US005310191A

United States Patent [19]

Booth

[11] Patent Number: 5,310,191

[45] Date of Patent: May 10, 1994

[54] BINGO CARD SHEET COVER ASSEMBLY

[76] Inventor: Joanne-Marie W. Booth, 370 Steeles Ave. E, Apt. 916, Brampton, Ontario, Canada, L6W 1A1

[21] Appl. No.: 36,360

[22] Filed: Mar. 24, 1993

[51] Int. Cl.[5] ..... A63F 3/06

[52] U.S. Cl. ..... 273/269; 273/148 R; 273/286

[58] Field of Search ..... 273/148 R, 240, 269, 273/270, 285, 286, 287

[56] References Cited

U.S. PATENT DOCUMENTS 3,873,092 3/1975 Fagan ..... 273/269 X
3,913,921 10/1975 Bourassa ..... 273/240 X
4,422,645 12/1983 Simons ..... 273/286

FOREIGN PATENT DOCUMENTS 0446696 9/1991 European Pat. Off. ..... 273/269

*Primary Examiner*—Vincent Millin
*Assistant Examiner*—William M. Pierce
*Attorney, Agent, or Firm*—Leon Gilden

[57] ABSTRACT

A flexible polymeric web arranged for storage in a furled configuration positioned within a tubular container is removable from the container for positioning over bingo cards. The sheet formed of a flexible polymeric film includes a plurality of contrasting patterns of various symbols positioned over and in aligned configuration with corresponding squares of a bingo card to permit marking within each symbol alone relative to bingo games requiring symbol designations for a winning card.

1 Claim, 4 Drawing Sheets

BINGO CARD SHEET COVER ASSEMBLY

BACKGROUND OF THE INVENTION

1. Field of the Invention

The field of invention relates to bingo card structure, and more particularly pertains to a new and improved bingo card sheet cover assembly wherein the same is arranged for positioning over bingo cards in a manner to align various openings within the sheet with corresponding squares of a bingo card.

2. Description of the Prior Art

Contemporary play of bingo cards typically employs various patterns relative to a bingo card to provide for a winning game. Such patterns may include lettering configurations such "T", "O", "M", and the like. The instant invention sets forth an improvement over the prior art to provide for an individual sheet having a plurality of patterns of openings to correspond with desired patterns relative to a bingo card game. Prior art structure is indicated in the U.S. Pat. Nos. 5,031,918; 4,869,611; 3,436,163; 4,878,669 and 4,019,747.

SUMMARY OF THE INVENTION

In view of the foregoing disadvantages inherent in the known types of bingo card apparatus now present in the prior art, the present invention provides a bingo sheet card cover assembly wherein the same is arranged to provide for a flexible polymeric web having a plurality of patterns of openings directed therethrough, wherein the openings are positioned in adjacency relative to one another relative to each pattern. As such, the general purpose of the present invention, which will be described subsequently in greater detail, is to provide a new and improved bingo card sheet cover assembly which has all the advantages of the prior art bingo card apparatus and none of the disadvantages.

To attain this, the present invention provides a flexible polymeric web arranged for storage in a furled configuration positioned within a tubular container and removable from the container for positioning over bingo cards. The sheet formed of a flexible polymeric film includes a plurality of contrasting patterns of various symbols positioned over and in aligned configuration with corresponding squares of a bingo card to permit marking within each symbol alone relative to bingo games requiring symbol designations for a winning card.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bingo card sheet cover assembly which has all the advantages of the prior art bingo card apparatus and none of the disadvantages.

It is another object of the present invention to provide a new and improved bingo card sheet cover assembly which may be easily and efficiently manufactured and marketed.

It is a further object of the present invention to provide a new and improved bingo card sheet cover assembly which is of a durable and reliable construction.

An even further object of the present invention is to provide a new and improved bingo card sheet cover assembly which is susceptible of a low cost of manufacture with regard to both materials and labor, and which accordingly is then susceptible of low prices of sale to the consuming public, thereby making such bingo card sheet cover assemblies economically available to the buying public.

Still yet another object of the present invention is to provide a new and improved bingo card sheet cover assembly which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
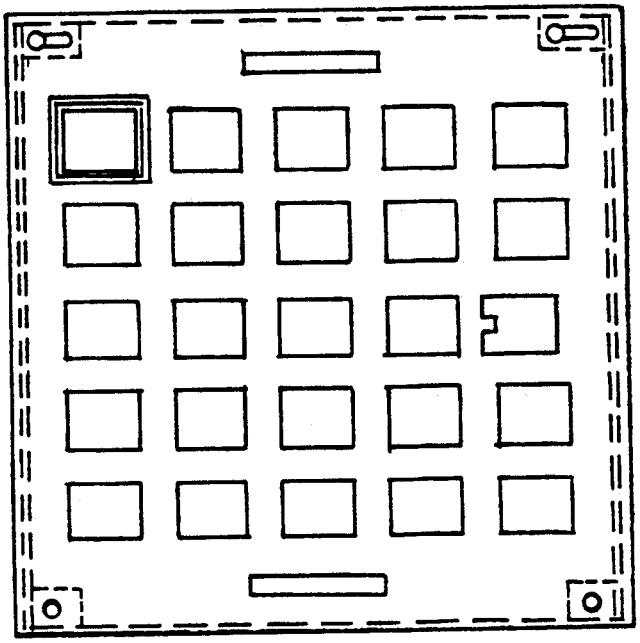
FIG. 1 PRIOR ART
FIG. 1 is an orthographic view of a prior art bingo card cover structure, as indicated in the U.S. Pat. No. 4,878,669, employing stamping means attached to the bottoms of each button to permit ease of stamping of an underlying bingo card, wherein the cover is of a rigid configuration receiving a bingo card thereunder.

With reference now to the drawings, and in particular to FIGS. 1 to 9 thereof, a new and improved bingo card sheet cover assembly embodying the principles and concepts of the present invention and generally designated by the reference numeral 10 will be described.

Figure 2:
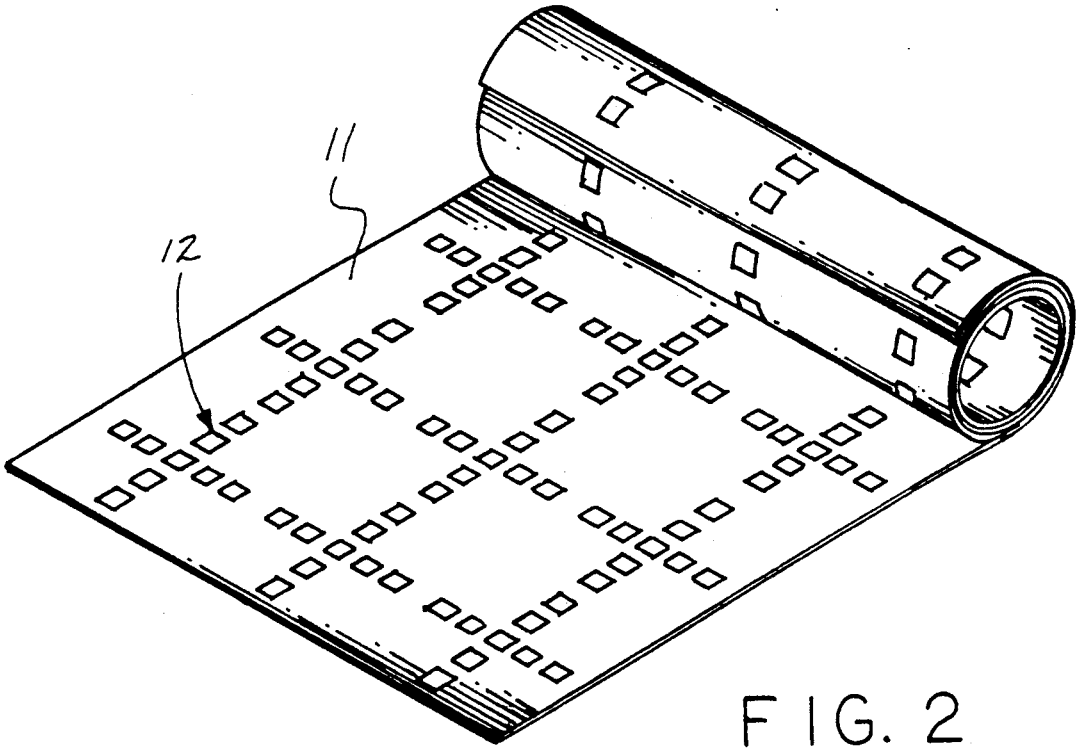
FIG. 2 is an isometric illustration of the web structure of the invention.
Figure 3:
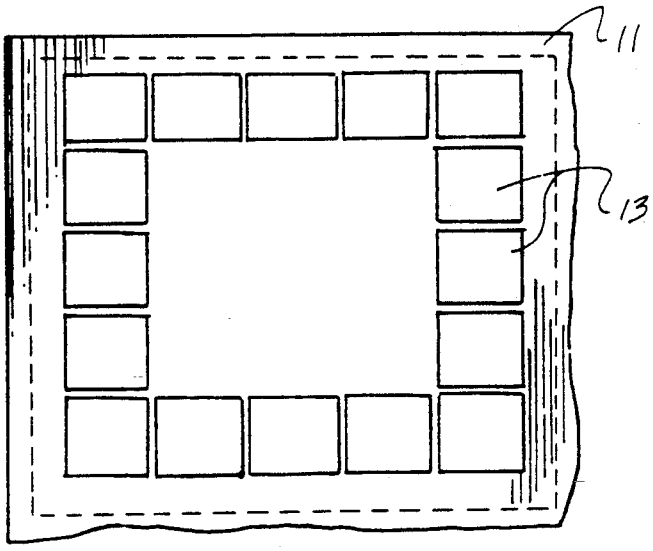
FIG. 3, FIG. 4, FIG. 5, FIG. 6, FIG. 7, and FIG. 8 indicate patterns directed through the flexible web of the instant invention.
Figure 4:
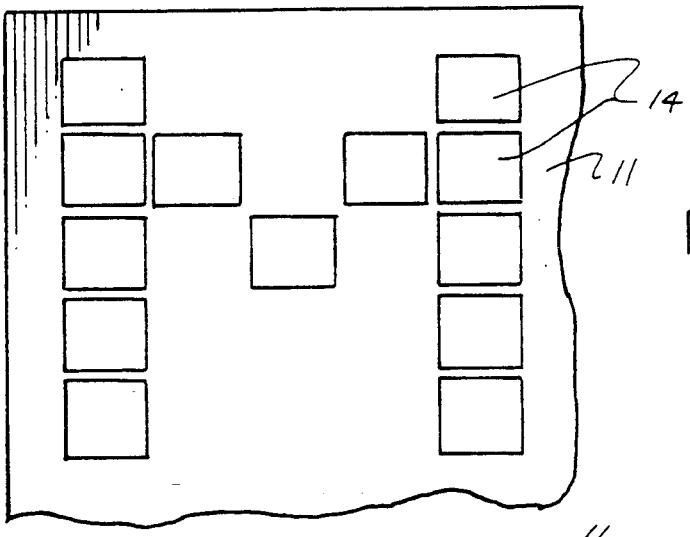
Figure 5:
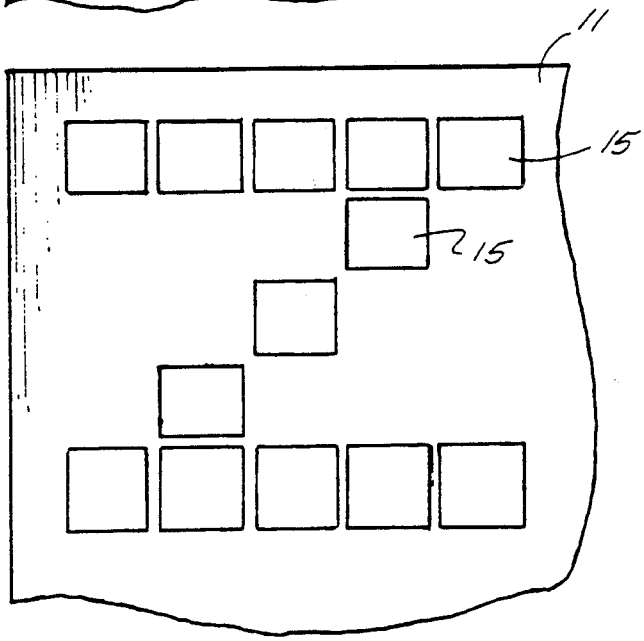
Figure 6:
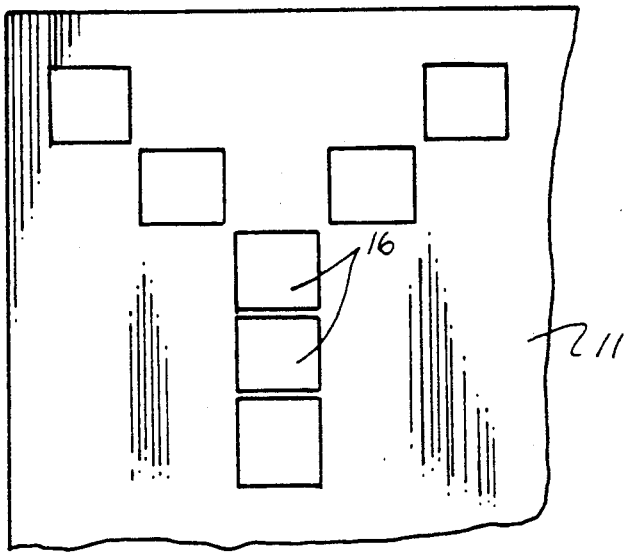
Figure 7:
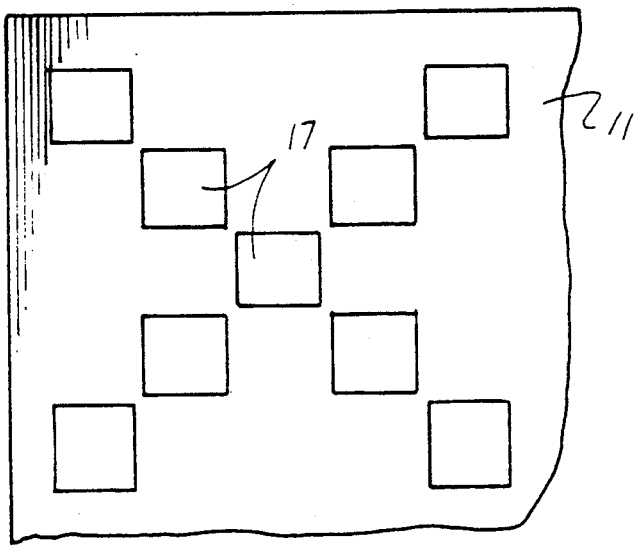
Figure 8:
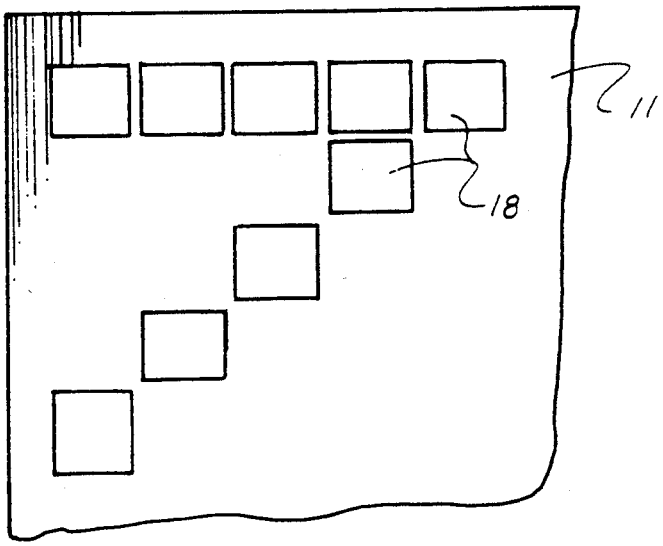

More specifically, the bingo card sheet cover assembly 10 of the instant invention essentially comprises an elongate flexible transparent web 11, such as indicated in FIG. 2, having a plurality of patterns of web openings, to include respective first, second, third, fourth, fifth, and sixth patterns of openings 13, 14, 15, 16, 17, and 18 respectively, as indicated in the FIGS. 3–8 respectively. The patterns are indicative of various letter configurations such as "Y" relative to FIG. 6, the letter "X" as indicated in FIG. 7. Such letters as "O" of FIG. 3 and the like are provided. It should be noted that the letter and symbolic designations of patterns require the openings to be in adjacency relative to one another. The web is typically arranged to position an associated bingo card 23 (see FIG. 3) under the web, with the pattern of openings, such as openings 13, positioned over the card in alignment with individual spaces of the bingo card 23. In this manner, during a bingo game, only those openings are typically available for marking by an individual through the openings 13 for example.

Figure 9:
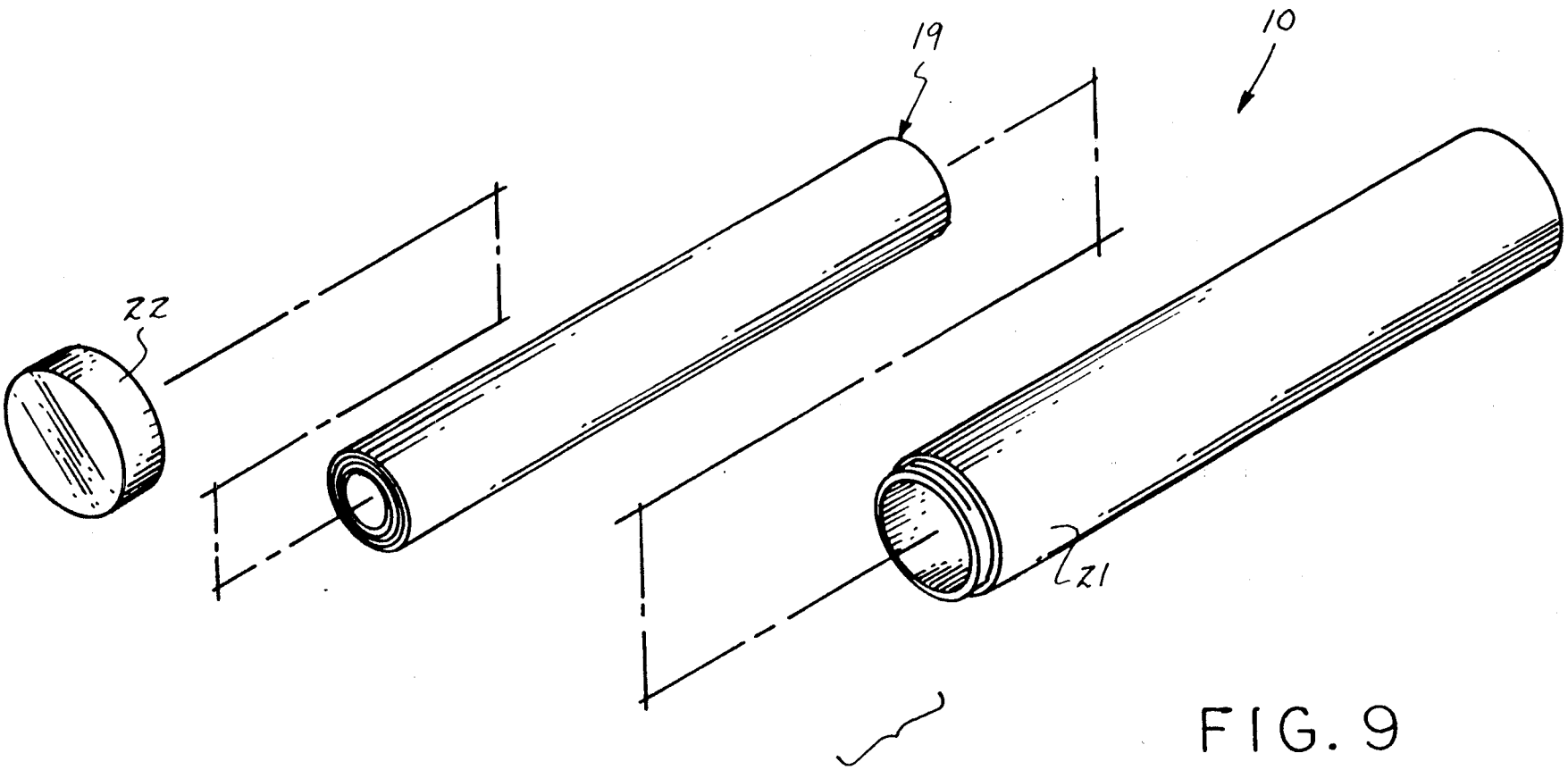
FIG. 9 is an isometric illustration of the furled web arranged for securement within the associated container during transport and storage thereof.

The FIG. 9 indicates the apparatus to include a tubular container 20 having a container opening 21 arranged to have a cap 22 securably mounted relative to the opening receiving the furled tube configuration of the web 11 indicated by the numeral 19 for storage and transport of the organization. It should also be understood that the web is formed of a polymeric type film permitting its ease of cleaning for reuse. Further, should additional patterns be required, additional patterns may be severed or punched through the web to accommodate such patterns.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bingo card sheet cover assembly, comprising, a tubular container, the tubular container having a container opening, and a cap member securably mounted in a selective relationship relative to the container about the opening, and an elongate flexible transparent web arranged in a first position in a furled configuration complementarily received within the tubular container and arranged for furling in a second orientation exteriorly of the container, wherein the web includes a plurality of patterns of openings directed through the web, the web has directed therethrough a first pattern of openings having an "O" shaped configuration, and a second pattern of openings having an "M" shaped configuration, and a third and fourth pattern of openings directed through the web having respective third and fourth arrays of openings.

* * * * *